US005628267A

United States Patent [19]

Hoshio et al.

[11] Patent Number: 5,628,267

[45] Date of Patent: May 13, 1997

[54] OSCILLATION SUPPRESSION DEVICE AND SHIP PROVIDED WITH THE SAME

[75] Inventors: Akinori Hoshio; Katsuya Umemura; Hiroshi Takeuchi, all of Komaki, Japan

[73] Assignee: Mitsubishi Jukogyo Kabushiki Kaisha, Tokyo, Japan

[21] Appl. No.: 329,517

[22] Filed: Oct. 26, 1994

[30] Foreign Application Priority Data

Nov. 1, 1993 [JP] Japan ..... 5-273735
Feb. 2, 1994 [JP] Japan ..... 6-010874

[51] Int. Cl.[6] ..... B63B 39/00

[52] U.S. Cl. ..... 114/122; 244/165

[58] Field of Search ..... 114/121, 122; 244/165; 74/5.22, 5.4, 5.47, 5.7, 5.45; 188/187, 163, 185

[56] References Cited

U.S. PATENT DOCUMENTS

| | | | |
|---|---|---|---|
| 1,571,264 | 2/1926 | Gretsch | 114/122 |
| 2,046,735 | 7/1936 | Frisch et al. | 114/122 |
| 3,219,292 | 11/1965 | Chubb | 244/165 |
| 3,424,401 | 1/1969 | Maurer | 244/165 |
| 3,465,862 | 9/1969 | Birdsall | 188/163 |
| 3,591,108 | 7/1971 | Perkel | 244/165 |
| 5,437,420 | 8/1995 | Rosen | 74/5.4 |

FOREIGN PATENT DOCUMENTS

| | | |
|---|---|---|
| 444096 | 9/1925 | Germany . |
| 1240052 | 7/1971 | United Kingdom . |

*Primary Examiner*—Edwin L. Swinehart
*Attorney, Agent, or Firm*—Wenderoth, Lind & Ponack

[57] ABSTRACT

An oscillation suppression device is provided for attenuating oscillation of an object to be controlled by a gyro torque of a control moment gyro having a flywheel rotating at a high speed. The oscillation suppression device includes an angular velocity detector for detecting an oscillation angular velocity of the object to be controlled. A control unit is connected to a gimbal shaft of the control moment gyro for controlling the angular velocity θ of the gimbal of the control moment gyro so as to absorb an external torque generated in the object to be controlled. The control unit operates in response to the oscillation angular velocity Φ, which is detected by the angular velocity detector.

10 Claims, 12 Drawing Sheets

OSCILLATION SUPPRESSION DEVICE AND SHIP PROVIDED WITH THE SAME

BACKGROUND OF THE INVENTION

1. Field of the Invention

The present invention relates to a oscillation suppression device applied to a small ship or a boat such as a leisure boat, a suspension type transportation machine such as a gondola, a suspension from a helicopter or the like. It also relates to a ship provided with the oscillation suppression device.

2. Description of the Related Art

In a conventional oscillation suppression device for suppressing oscillation of a small ship, such as a leisure boat, a drum brake or a generator is coupled to a gimbal shaft so that an angular velocity of the gimbal may be adjusted by the resistance of the drum brake or the generator.

FIG. 14 shows an arrangement of the conventional oscillation suppression device. A flywheel 1 which constitutes the oscillation suppression device is connected to a flat type spin motor 2 through a spin shaft 9 and is rotated at a high speed (with an angular velocity Q of the flywheel) by the spin motor 2. The flywheel 1 is supported by a gimbal 4 through spin system bearings 3*a* and 3*b* so as not to be prevented from rotating at a high speed.

The gimbal 4 has a gimbal shaft 4*a* and rotates about the gimbal shaft 4*a* at an angular velocity θ. The gimbal shaft 4*a* is supported by support frames 6*a* and 6*b* through gimbal system bearings 5*a* and 5*b* so that the gimbal 4 is not prevented from rotating. Further, each support frame 6*a*, 6*b* is fixed to an object 10 in which oscillation is to be suppressed by the oscillation suppression device. The support frames 6*a* and 6*b* transmit a gyro torque Tψ generated by the rotation of the gimbal 4 to the object to be controlled for reducing the oscillation angular velocity Φ of the object to be controlled.

A drum brake 7 or a generator 8 is connected to one end of the gimbal shaft 4*a*. The angular velocity θ of the gimbal is controlled by the resistance of the drum brake 7 or the generator 8. Thus, the gyro torque Tψ is controlled and the oscillation angular velocity Φ of the object to be controlled is reduced. As shown in FIG. 15, the drum brake 7 is provided on the gimbal shaft 4*a* of a control moment gyro so that the angular velocity θ of the gimbal 4 is controlled by the frictional force of the drum brake 7.

In the case where the drum brake 7 is used for controlling the angular velocity θ of the gimbal 4, the brake torque to be applied to the gimbal shaft 4*a* may be kept constant. For this reason, it is impossible to finely control the oscillation relative to the oscillation angular velocity Φ of the object to be controlled. Also, since a frequency band of oscillation for the object to be controlled is narrow, it is impossible to apply this system to objects where the amplitude of the oscillations is large.

Also, if the drum brake 7 is used, it is difficult to remove dust, moisture or the like adhered to a surface of the drum brake 7, and the heat radiation from the frictional surface is not satisfactory. Accordingly, it is difficult to properly maintain the drum brake, which results in deteriorating performance.

On the other hand, in the case where the generator 8 is used to control the rotation of the gimbal shaft 4*a*, a load resistor having a predetermined resistor value is connected to a terminal of the generator 8 to be connected to the gimbal shaft 4*a* to impart a brake force to the rotation of the gimbal shaft 4*a* to thereby control the angular velocity θ of the gimbal 4 as disclosed in Japanese Patent Application Laid-Open No. Hei 6-129484 filed by the present applicants and entitled "Rotary Oscillation Suppressing Device". However, since the resistor value of the resistor provided in the generator 8 is kept constant, the same problem would be encountered as in the case of the brake drum 7.

OBJECTS OF THE INVENTION

In view of the foregoing problems, an object of the present invention is to provide a oscillation suppression device which is capable of controlling an angular velocity θ of a gimbal in response to an external turbulence imposed on the object to be controlled, and of suitably controlling the angular velocity even if the external turbulence is changed while still providing the oscillation suppression effect.

Another object of the invention is to provide a ship including the above-described oscillation suppression device.

SUMMARY OF THE INVENTION

According to the present invention, in order to attain the above-described and other objects, a oscillation suppression device is provided for reducing the vibratory angular velocity of the object to be controlled by controlling the angular velocity of the gimbal to control the gyro torque. Also, a ship provided with the oscillation suppression device is disclosed.

The oscillation suppression device includes a control moment gyro having a flywheel. Angular velocity detecting means are provided for detecting an oscillation angular velocity of an object to be controlled.

The oscillation suppression device also includes control means connected to a gimbal shaft of the control moment gyro for controlling the angular velocity of a gimbal to absorb an external torque generated in the object to be controlled. The control means operates in response to the oscillation angular velocity detected by said angular velocity detecting means.

An angular velocity detector is provided for detecting the angular velocity of the object to be controlled due to external turbulence or the like. The detected angular velocity signal is fed to the control means. The control means changes the torque for braking the gimbal shaft in response to the received angular velocity signal to change the angular velocity of the gimbal. Thus, it is possible to control the angular velocity of the gimbal in response to the external turbulence.

Also, according to the present invention, the control means may include an electromagnetic brake connected to the gimbal shaft for braking the gimbal shaft. An electromagnetic brake control means controls the electromagnetic brake in response to the angular velocity detected by the angular velocity detecting means.

Thus, the swing angular velocity, created by an external turbulence or the like and detected by an angular velocity sensor, is fed to the electromagnetic brake controller which controls an excited magnetic current to be fed to the electromagnetic brake. Thus, the brake torque of the electromagnetic brake is changed to brake the gimbal shaft in response to the angular velocity signal in order to change the angular velocity of the gimbal. Thus, it is possible to control the angular velocity of the gimbal in response to the external turbulence.

Also, according to the present invention, the control means may include a generator connected to the gimbal shaft for braking the gimbal shaft. A variable resistor is connected to said generator, and a resistor value control means is provided for controlling a resistor value of the variable resistor in response to the angular velocity detected by the angular detecting means.

Thus, the angular velocity signal in response to the angular velocity detected by the angular velocity sensor is fed to the resistor controller. The resistor controller controls the resistor value of the variable resistor in response to the received angular velocity signal. The resistor value of the variable resistor is changed, and the resistance of the generator is changed to change the angular velocity of the gimbal connected to the generator. Thus, it is possible to control the angular velocity of the gimbal in response to the external turbulence.

Also, according to the present invention, the control means may include a disc brake for braking the gimbal shaft. The disc brake includes a friction disc fixedly coupled to the gimbal shaft and another friction disc coupled to a support frame that supports the gimbal shaft through gimbal bearings.

Thus, the disc brake operates in response to the angular velocity detected by the angular detecting means. The gimbal shaft is braked by the frictional force generated between the surfaces of the two friction discs to thereby control the angular velocity of the gimbal in response to the external turbulence.

By employing the disc brake, the structure of the friction brake for braking the gimbal shaft is simplified so that an inspection may readily be performed. Also, in the worst case, it is easy to carry out the maintenance by simply replacing the friction discs. Furthermore, it is possible to minimize adverse effects caused by heat generated by the frictional forces occurring in a braking operation.

Also, according to the present invention, the control means may include a powder brake for braking the gimbal shaft. The powder brake includes a magnetic disc fixedly coupled to the gimbal shaft. Permanent magnets and a magnetic viscous material are sealed in a casing that is fixed to a support frame for supporting the gimbal shaft through gimbal bearings. The casing also surrounds the magnetic disc and gaps are formed therebetween.

Thus, by means of the magnetic flux of the magnetic disc and the magnetic viscous material, the Coulomb friction force is applied to the rotational motion of the fixed disc to thereby control the angular velocity of the gimbal in response to the external turbulence.

Also, by employing the powder brake, the structure of the brake is simplified so that inspections may readily be performed. Alternatively, the magnetic discs may easily be replaced.

Also, according to the present invention, the control means may include an oil damper for braking the gimbal shaft. The oil damper includes a stirring disc fixedly coupled to the gimbal shaft and oil sealed in a casing. The casing is fixed to a support frame for supporting the gimbal shaft through gimbal bearings. The casing also surrounds the stirring disc so that a small gap is formed therebetween.

The gimbal shaft is braked by the resistance generated when the oil sealed within the oil casing is moved and passed through the small gaps between the oil casing and the stirring disc. The stirring disc is rotated in response to the rotation of the gimbal shaft. It is thus possible to control the angular velocity of the gimbal in response to the external turbulence.

Also, in the case where the oil damper (viscous damper) is used, the braking resistance for the gimbal shaft is not the Coulomb friction force but the braking resistance (viscous resistance) in proportion to the angular velocity of the gimbal shaft. Thus, there is no non-linear element. Therefore, it is possible to enhance the performance of the device.

As described above in detail, according to the oscillation suppression device of the present invention, in a control moment gyro having a flywheel rotating at a high speed, the brake is connected to the gimbal shaft and may take the form of an electromagnetic brake, a generator connected to a variable resistor, a disc brake, a powder brake, an oil damper or the like. In the case where the electromagnetic brake is connected to the device, the load torque of the electromagnetic brake is controlled in response to a change of external turbulence generated in the object to be controlled. In the case where the generator is connected thereto, the excited magnetic current to be fed to the generator is controlled in response to a change of external turbulence. In the same manner, in the case where the disc brake, the powder brake or the oil damper is connected thereto, the equipment to which the component is connected is controlled in response to a change of external turbulence to thereby control the angular velocity of the gimbal. It is therefore possible to avoid degradation of the oscillation performance due to external turbulence and to perform an effective oscillation suppressing control.

Furthermore, it is possible to arrange in a ship the gimbal shaft of the control moment gyro of the above-described oscillation suppression device in parallel to the pitch axial direction of the ship.

The above-described oscillation suppression device may be made compact and may be located in a limited narrow space. The invention may be applied to various boats, such as small leisure boats or leisure fishing boats which oscillate or swing with waves at various frequency to thereby obtain comfortable boats with small oscillation. Also, a battery can supply the power for the oscillation suppression device of the present invention. The invention may be applied to a small boat which has no power source, such as a generator which is driven by an internal combustion engine or like. Also, an extra controller for controlling the rotational speed of the flywheel, which is unsuitable under circumstances on the boat where humidity and temperature are both high, is dispensed with to provide an inexpensive boat with high reliability.

BRIEF DESCRIPTION OF THE DRAWINGS In the accompanying drawings.

DESCRIPTION OF THE PREFERRED EMBODIMENTS

The present invention will now be described with reference to the accompanying drawings.

Figure 1:
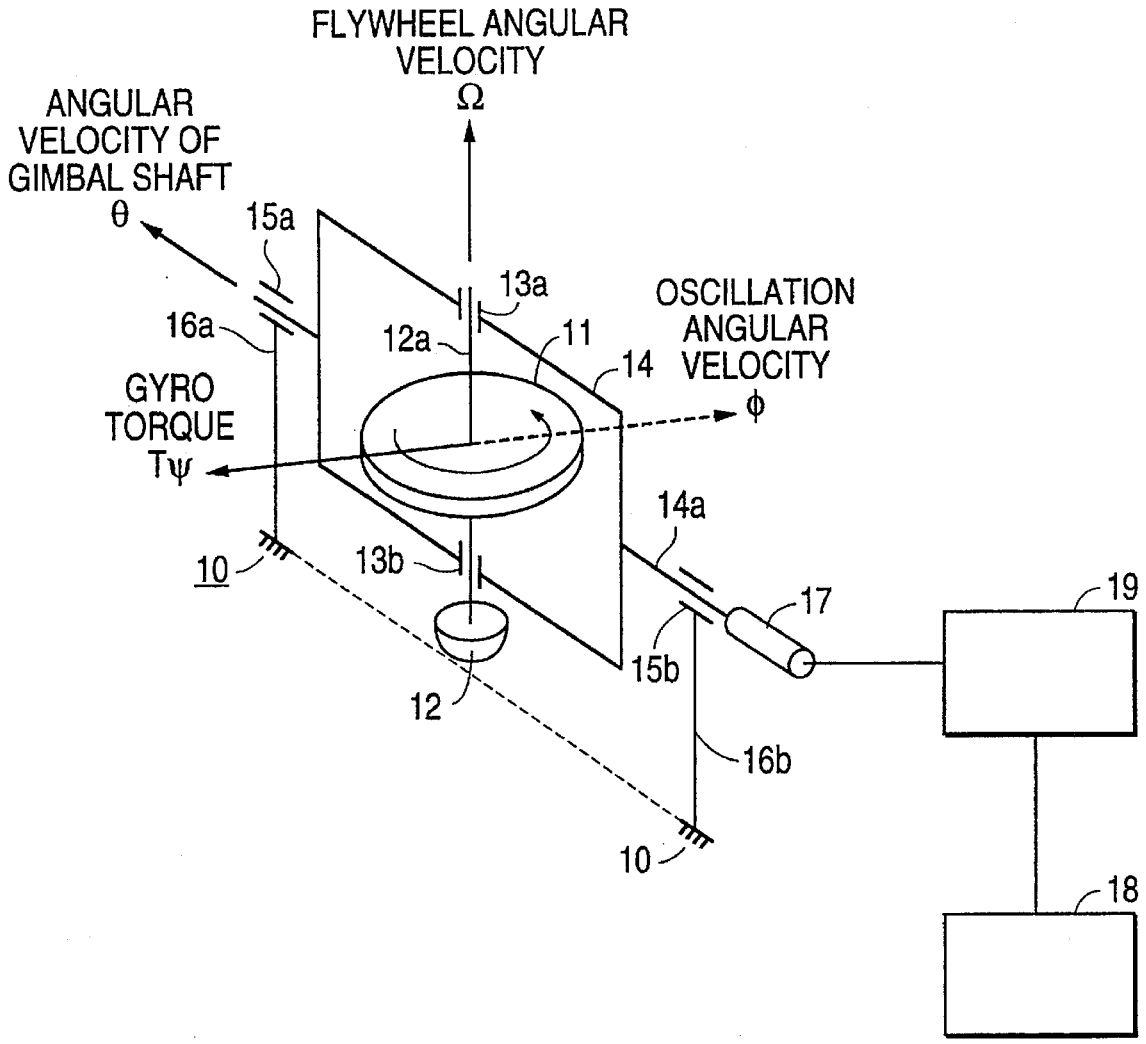
FIG. 1 is a schematic view showing a oscillation suppression device according to a first embodiment of the invention.

In FIG. 1 which shows a oscillation suppression device according to a first embodiment of the invention, a flywheel 11 is connected to a flat type spin motor 12 through a spin shaft 12*a* and is rotated at a high angular velocity Ω by the spin motor 12.

The rotational speed of the flywheel 11 is not controlled, but the flywheel 11 is always rotated at a fixed rotational speed which is balanced with by the loss caused by resistance to rotation. Accordingly, an extra controller is not required for controlling the rotational control. Thus, the number of electric and electronic components therefor is reduced to thereby enhance the reliability of the device and to reduce the cost therefor.

Figure 2:
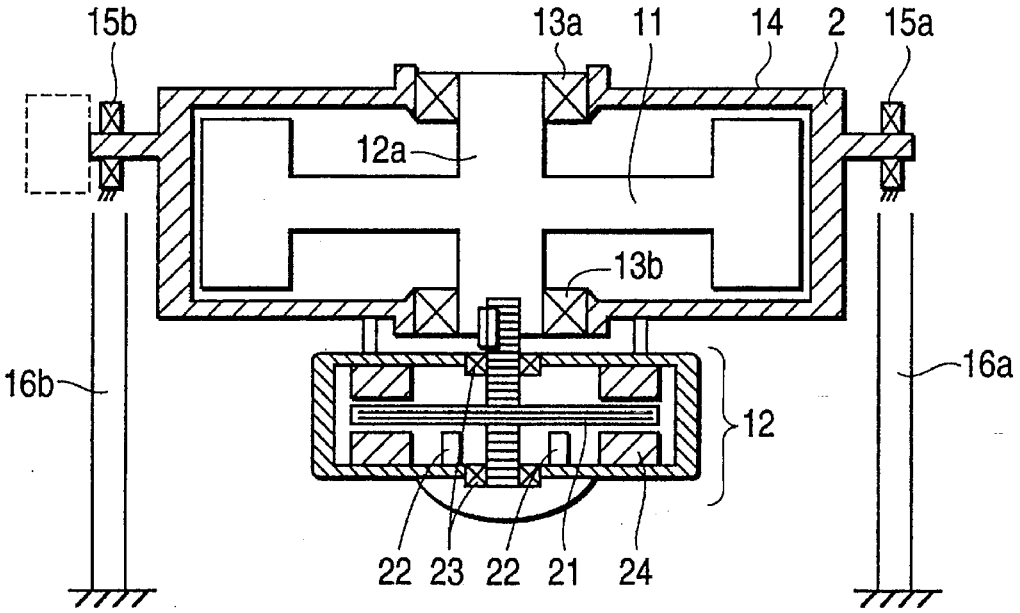
FIG. 2 is a cross-sectional view of the first embodiment shown in FIG. 1.

The flat cylindrical spin motor 12 for rotating the flywheel 11 is used for the purpose of allowing the overall oscillation suppression device to be more compact. As best shown in FIG. 2, the spin motor 12 is low in height so as to not hinder rotation of a gimbal 14.

Figure 3A:
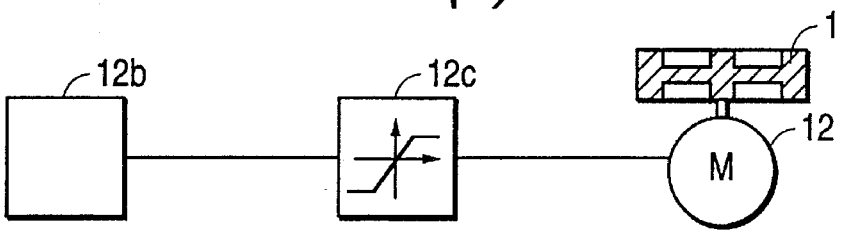
FIG. 3A is a block diagram showing a circuit for driving a spin motor applied to the embodiment shown in FIG. 1.
Figure 3B:
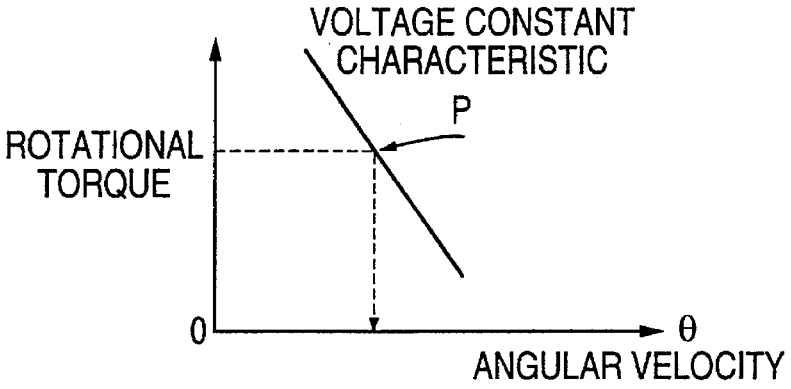
FIG. 3B is a graph showing a relationship between the rotational speed and the torque.

The spin motor 12 is composed of an armature 21, permanent magnets 24, brushes 22 and bearings 22. Since a printed motor is used for reducing the thickness of the armature 21, it is possible to make the motor compact in size. FIG. 3A is a block diagram showing an open control characteristic of the spin system for driving the spin motor and FIG. 3B is a graph showing a rotational speed-torque characteristic. As shown in FIG. 3A, in the spin system, a constant voltage is supplied from a battery 12*b* and a current is supplied directly to the spin motor 12 through a current limiter 12*c*. The flywheel 11 is coupled directly with the spin motor 12. The feedback control by a rotational speed sensor for the spin motor 12 or the like is not necessary. The rotational speed is determined by a voltage constant characteristic line shown in FIG. 3(B) at a point P where a balance is achieved with the rotational torque (frictional loss, air wind loss, eddy current loss, copper loss or the like). Thus, it is possible to dispense with the rotational speed controller as described above. Also, the current limiter 12*c* prevents the eddy current from flowing upon the drive of the motor 12 to thereby avoid damaging the motor 12.

Turning back to FIG. 1, the flywheel 11 is supported by the gimbal 14 through the spin system bearings 13*a* and 13*b* to suppress a loss due to the rotational resistance and to avoid a reduction in high speed rotation.

The gimbal 14 has a gimbal shaft 14*a* and rotates about the gimbal shaft 14*a* at an angular velocity θ. The gimbal shaft 14a is supported by support frames 16*a* and 16*b* through gimbal system bearings 15*a* and 15*b* so as not to obstruct rotation of the gimbal 14. Furthermore, the support frames 16*a* and 16*b* are fixed to a boat 10 to be controlled and transmits the gyro torque Tψgenerated by the rotation of the gimbal 14 to the boat 10. Also, one end of the gimbal shaft 14*a* is connected to an electromagnetic brake 17 so that the angular velocity θ of the gimbal 14 is changed in response to the load torque of the electromagnetic brake 17.

On the other hand, an angular velocity sensor 18 for detecting the oscillation angular velocity of the boat 10 is provided in the boat 10. The angular velocity sensor 18 detects the oscillation angular velocity on the real time basis and feeds an angular velocity speed to an electromagnetic brake controller 19 in response to the detected angular velocity Φ. The electromagnetic brake controller 19 controls an excited magnetic current to be fed to the electromagnetic brake 17 in response to the received angular velocity signal. Thus, the load torque of the electromagnetic brake will change.

The operation of the first embodiment will now be described. Now, let us assume that the flywheel 11 has been rotating at a high rotational speed at an angular velocity Ω. When the boat 10 is subjected to a change in oscillation angular velocity Φ by external turbulence or the like, the angular velocity sensor 18 detects the oscillation angular velocity Φ and the angular velocity signal is fed to the electromagnetic brake controller 19 which controls the excited magnetic current to be fed to the electromagnetic brake 17 in response to the received angular velocity signal. In this case, the electromagnetic brake controller 19 controls the excited magnetic current so that a gyro torque Tψ for reducing the oscillation angular velocity Φ of the object to be controlled is generated. In the electromagnetic brake 17, the load torque is changed in response to the excited magnetic current whereby the angular velocity θ of the gimbal 14 will change.

Thus, it is possible to avoid degradation in control performance against the external turbulence of the object to be controlled and to perform an optimum suppression of the oscillation.

Figure 4:
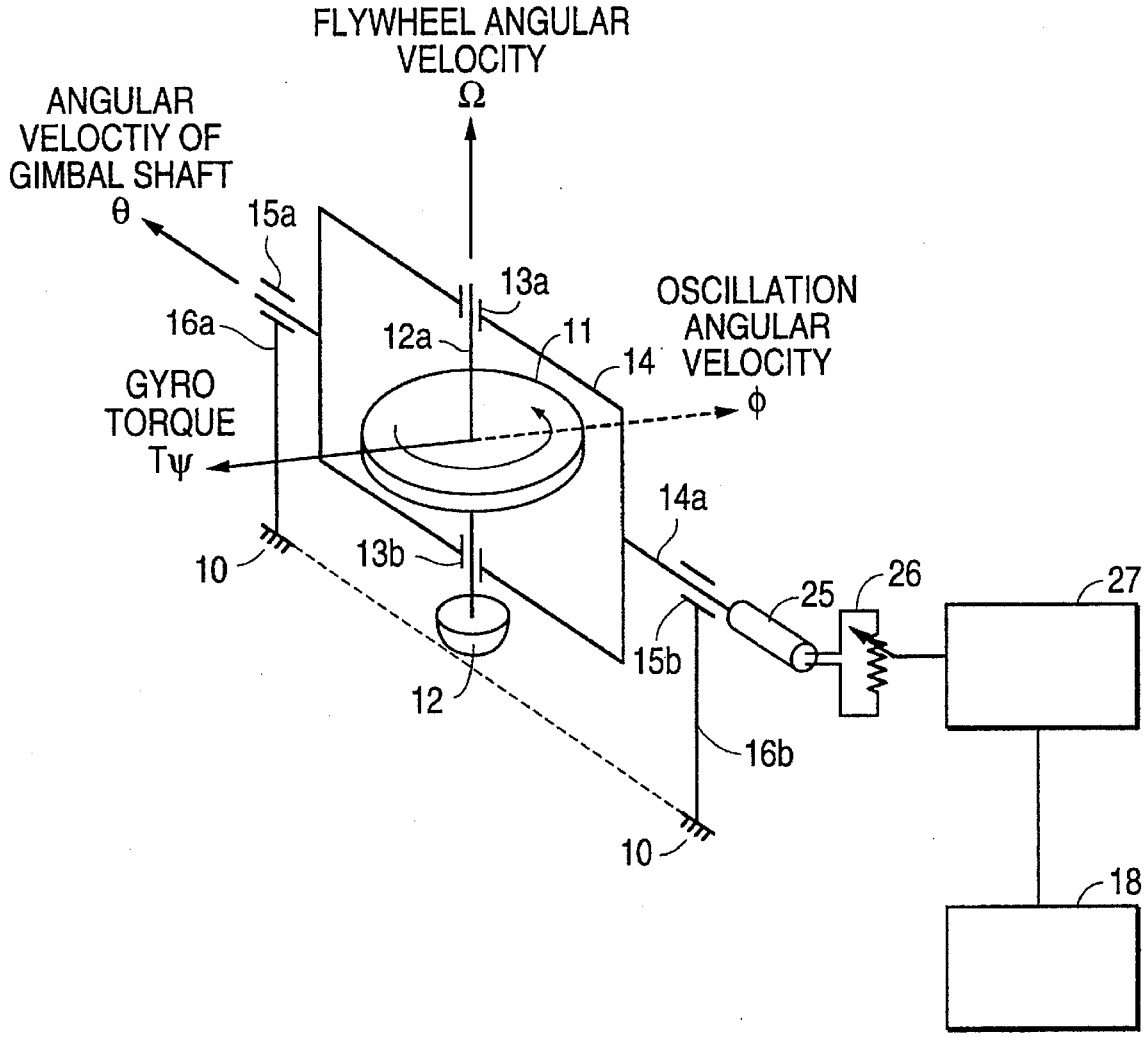
FIG. 4 is a schematic view showing a oscillation suppression device according to a second embodiment of the invention.

In a second embodiment of the invention shown in FIG. 4, a generator 25 is connected to one end of the gimbal shaft 14*a*. A variable resistor 26 is connected to the generator 20 and the resistor value of the variable resistor 26 is changed by controlling a resistor controller 27. An angular velocity signal, fed from an angular velocity sensor 18 provided at a predetermined position, is fed into the resistor controller 27 to thereby control the resistor value of the variable resistor 26 in response to the angular velocity signal.

The operation of the second embodiment will now be described. Now, let us assume that the flywheel 11 has been already rotated at a high rotational speed at an angular velocity Ω. When the boat 10 is subjected to a change in oscillation angular velocity Φ by external turbulence or the like, the angular velocity sensor 18 detects the oscillation angular speed and feeds the angular velocity signal to the resistor controller 27. The resistor controller 27 controls the resistor value of the variable resistor 26 in response to the received angular velocity signal. In this case, the resistor controller 27 controls the resistor value so that a gyro torque Tψ for reducing the oscillation angular velocity Φ of the object to be controlled is generated. The generator 25 imparts the load to the rotating gimbal shaft 14*a* in response to the resistor value of the variable resistor 26 and thereby the angular velocity θ of the gimbal 14 will change.

Figure 5A:
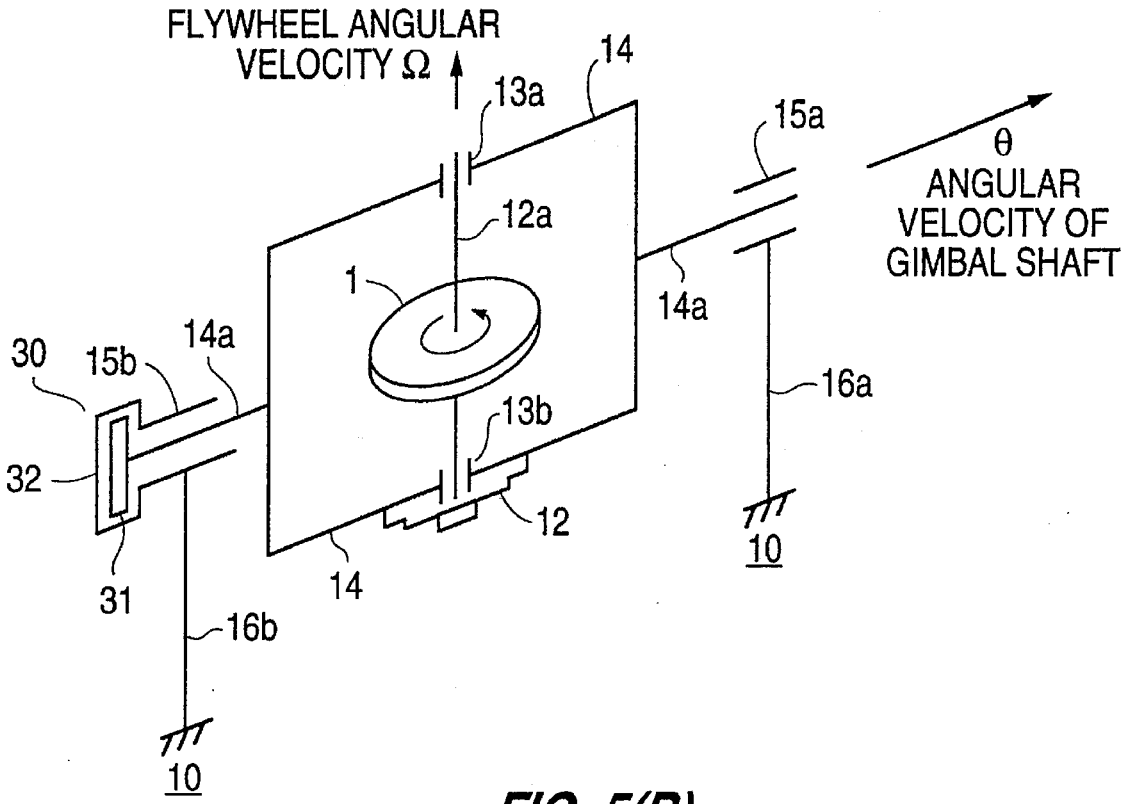
FIGS. 5A and 5B are schematic views showing a oscillation suppression device according to a third embodiment of the invention.
Figure 5B:
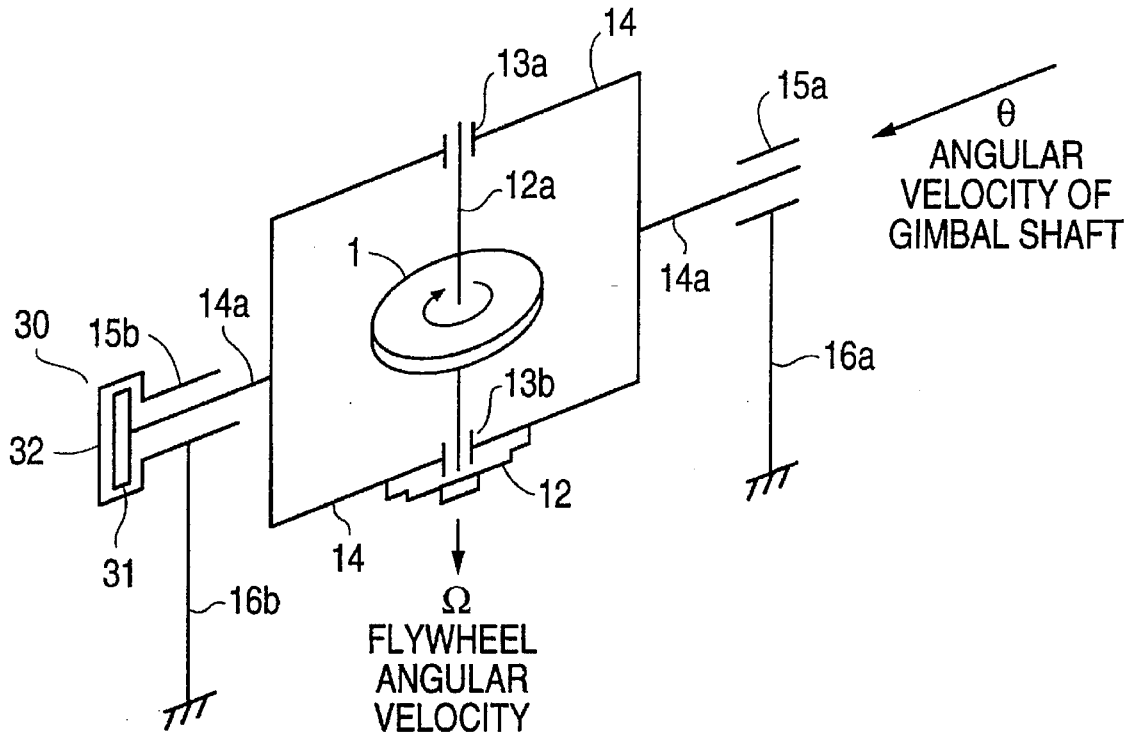
Figure 6A:
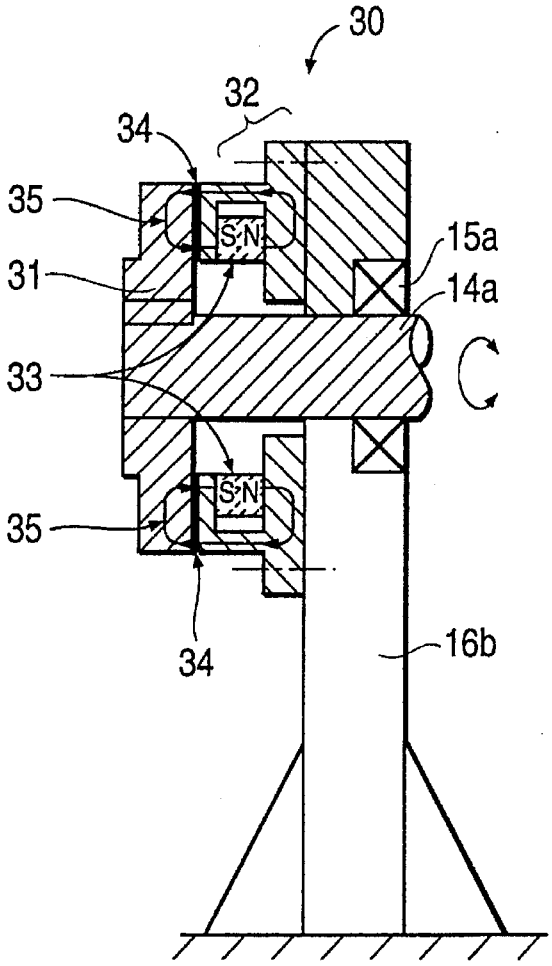
FIG. 6A is a view showing a disc brake in accordance with the embodiment shown in FIGS. 5A and 5B.

In an oscillation suppressing device in accordance with a third embodiment of the present invention shown in FIGS. 5A, 5B, 6A and 6B, a disc brake 30 is mounted as a brake for braking the oscillation of the gimbal shaft 14*a*. The disc brake 30 is composed of a friction disc 31 fixed to the gimbal shaft 14*a* and a friction disc 32 fixed to a support frame 16*b* as shown in FIG. 6A. The rotation of the gimbal 14*a* is braked by the frictional torque generated upon the frictional contact between the friction disc 32 fixed to the side of the support frame 16*b* and the friction disc 31 fixed to the gimbal 14*a*.

Figure 6B:
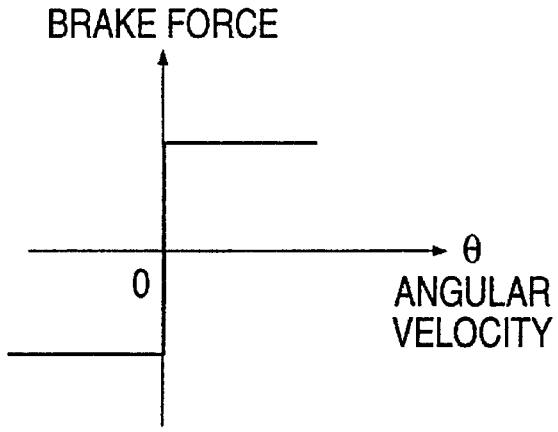
FIG. 6B is a graph showing a braking characteristic of the disc brake shown in FIG. 6A.

A plurality of permanent magnets 33 and a braking plate 34 are arranged on the friction disc 32 fixed to the support frame 16*b*, and a magnetic flux caused by the permanent magnets is applied between the frictional disc 31 fixed to the gimbal shaft 14a and the frictional disc 32, whereby a Coulomb friction force acts against the rotational motion of the gimbal 14 to thereby suppress the oscillation of the gimbal 14. At this time, the braking force that is kept substantially constant may be obtained by the magnetic flux of the permanent magnets 33 as shown in FIG. 6B.

However, the electromagnetic brake 17 used in the first embodiment may be used instead of the permanent magnets 33 so that the braking of the gimbal shaft 14 may be attained in the same manner as in the first embodiment.

Figure 7A:
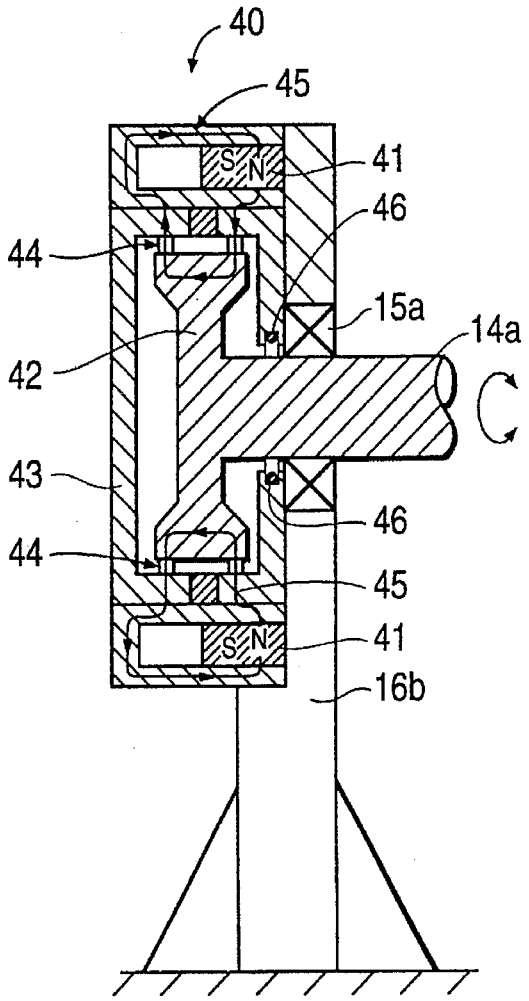
FIG. 7A is a view showing a powder brake in accordance with a fourth embodiment.
Figure 7B:
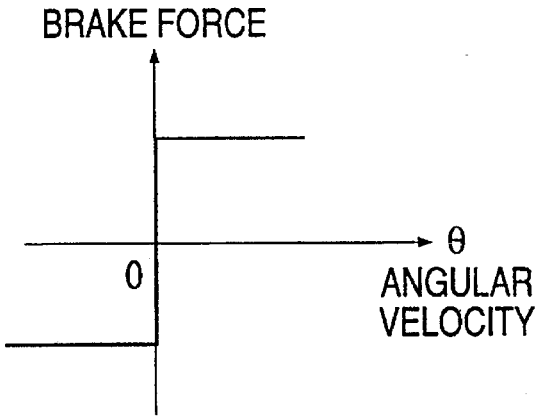
FIG. 7B is a graph showing a braking characteristic of the powder brake shown in FIG. 7A.

In an oscillation suppressing device in accordance with a fourth embodiment of the invention shown in FIG. 7A, a powder brake 40 is mounted as a brake for braking the oscillation of the gimbal shaft 14*a*. The powder brake 40 is composed of permanent magnets 41 provided on the support frame 16*b*, a magnetic disc 42 fixed to the gimbal shaft 14*a*, and magnetic viscous material (powder) 44 provided for surrounding the magnetic disc 42 by providing seals 46 at a through-portion of the gimbal shaft 14*a* and sealed within a casing 43 that is fixed to the support frame 16*b*. Then, the magnetic flux 45 caused by the permanent magnets 41 is applied to the magnetic viscous material 44 whereby the Coulomb friction force acts against the rotational motion of the gimbal 14 to thereby brake the oscillation of the gimbal 14. At this time, the brake force that may be kept constant may be obtained by the magnetic flux 45 of the permanent magnets 41 as shown in FIG. 7B. However, also in this embodiment, the electromagnets may be used instead of the permanent magnets 41 and the excited magnetic current to be supplied to the electromagnets is controlled. As a result, it is possible to control the angular velocity of the gimbal so as to absorb the turbulent torque generated in the object to be controlled.

Figure 8A:
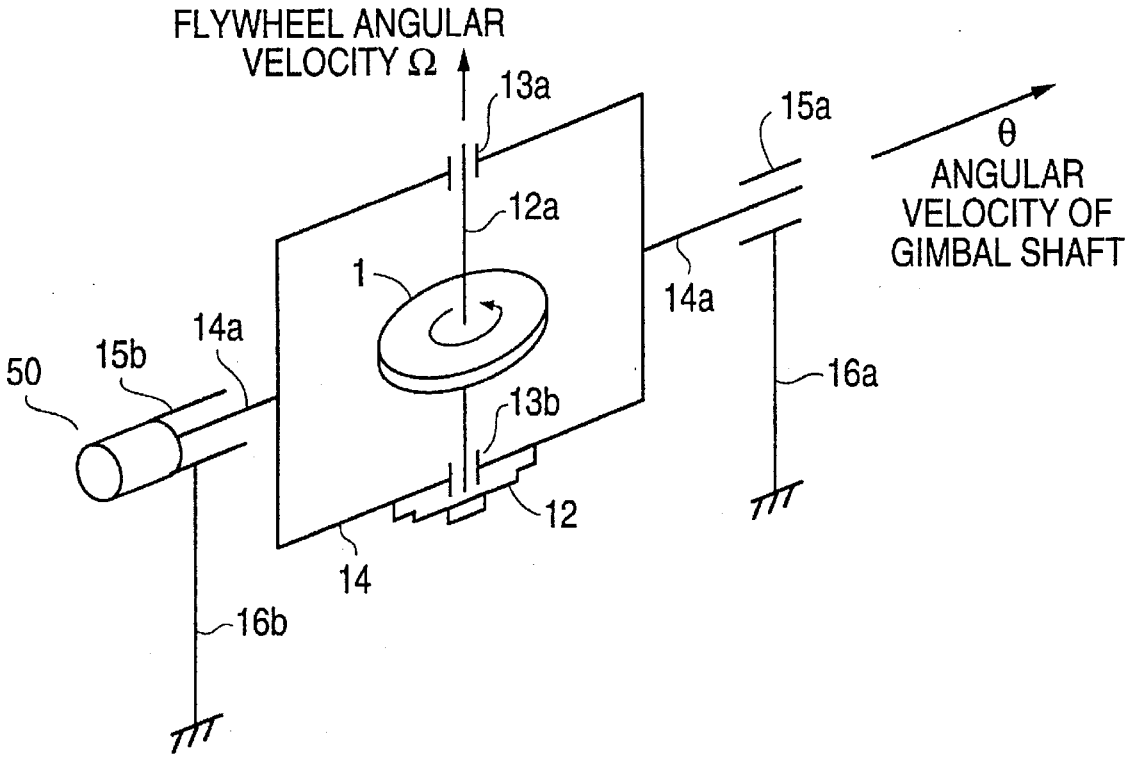
FIGS. 8A and 8B are schematic views showing a oscillation suppression device according to a fifth embodiment of the invention.
Figure 8B:
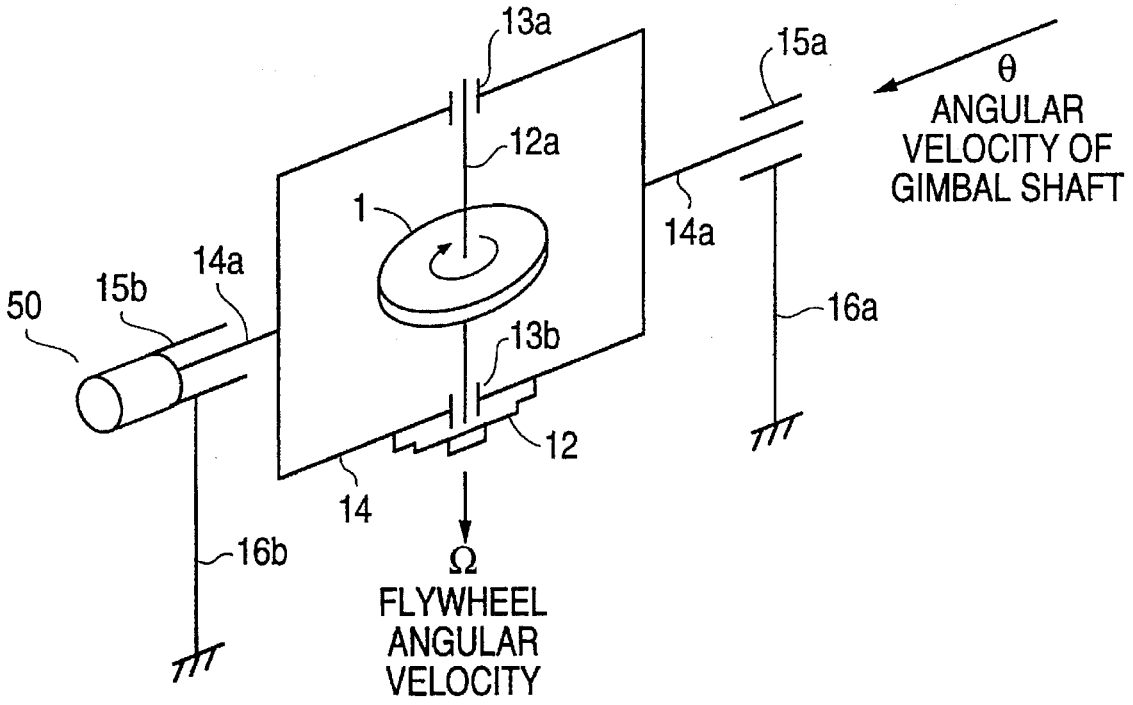
Figure 9A:
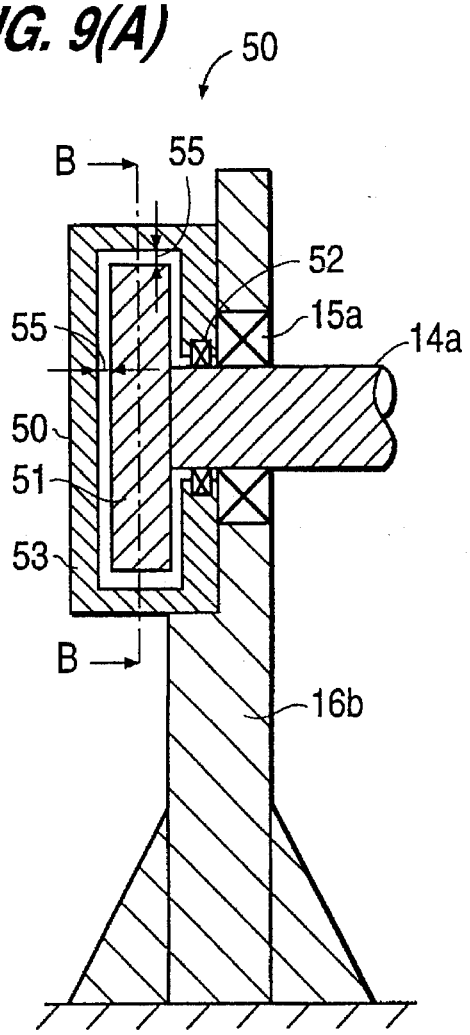
FIG. 9A is a view showing an oil damper in accordance with the embodiment shown in FIGS. 8A and 8B.

In an oscillation suppressing device in accordance with a fifth embodiment of the invention shown in FIGS. 8A, 8B and 9A, an oil damper (viscous damper) 50 is used as a braking device for the gimbal shaft 14*a*.

The feature of this embodiment is that the braking force in proportion to the gimbal angular velocity θ is obtained in response to the rotation force generated in the gimbal shaft 14a. In the third and fourth embodiments, the frictional braking force is caused by the Coulomb friction force, but in this embodiment, the braking force is caused by the viscous friction. Accordingly, it is possible to ensure a higher performance than that of the third and fourth embodiments.

The oil damper (viscous damper) 50 is formed as follows. As shown in FIG. 9A, an oil seal 52 is provided between an oil casing 53 and the gimbal shaft 14*a* adjacent the stirring disc 51 (see the cross-section B-B) that is fixed to the gimbal shaft 14*a*. The oil casing 53, which completely surrounds the stirring disc 51, is fixed to the support frame 16*b*. The interior of the oil casing 53 is filled with oil (silicone oil or the like) 54. The resistance is caused when the oil 54 passes through narrow gaps 55 formed between the casing 53 of the oil damper 50 and the disc 51. The resistance is used as the brake force of the gimbal shaft 14a to thereby brake the oscillation of the gimbal 14.

Figure 9B:
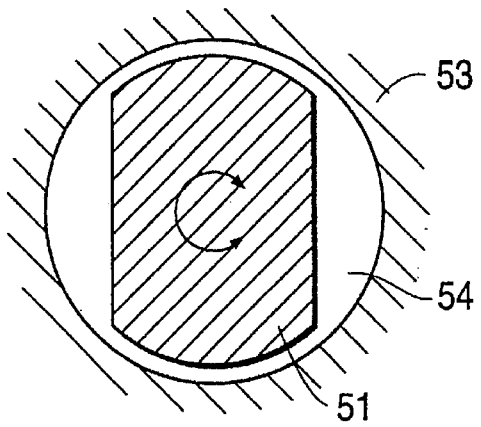
FIG. 9B is a cross-section taken along line B—B of FIG. 9A.
Figure 9C:
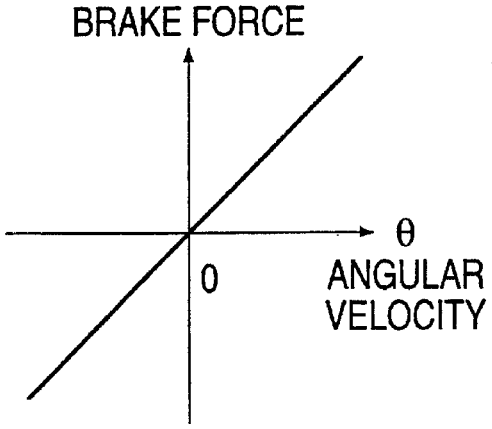
FIG. 9C is a graph showing a braking characteristic of the oil damper shown in FIG. 9A.

At this time, the brake force of the oil damper 50 acts as the viscous friction in proportion to the angular velocity θ as shown in FIG. 9B on a theoretical basis. Accordingly, it is possible to ensure the linear brake control, and it is easy to control the gimbal 14.

Figure 10:
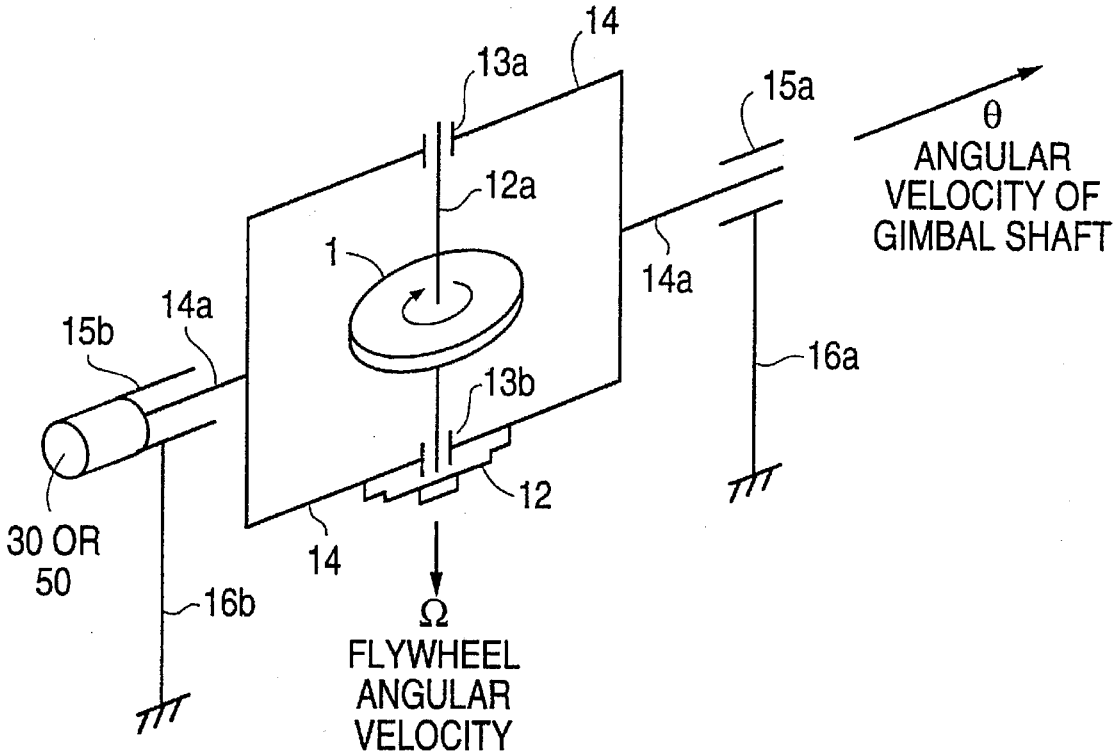
FIG. 10 is a schematic view showing a oscillation suppression device according to a sixth embodiment of the invention.

In an oscillation suppressing device in accordance with a sixth embodiment of the present invention shown in FIG. 10, relating to the fifth embodiment shown in FIGS. 8A and 8B or the third embodiment shown in FIG. 5A and 5B, it is possible to adjust the oscillation angular velocity of the gimbal 14 by using the disc brake 30 or the oil damper 50 as the brake at a low magnitude. According to this embodiment, since the component in the yawing axial direction even for one set of the oscillation suppressing device is small, it has an advantage of not always being necessary to provide two devices for one set.

Figure 11:
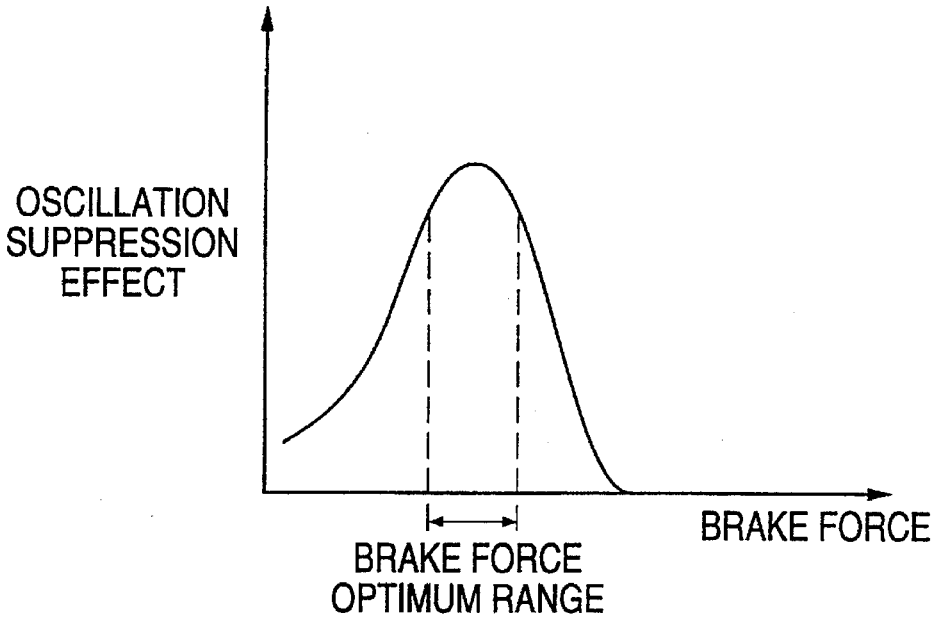
FIG. 11 is a graph showing the oscillation suppression effect and the brake force.

Subsequently, FIG. 11 shows the relationship between the brake force for braking the gimbal shaft 14*a* described above and the oscillation suppression effect. As shown in FIG. 11, in order to obtain the best oscillation suppression effect in the range of the optimum values of the brake force, it is necessary to adjust, in advance, the brake force relative to the respective brakes, i.e., the electromagnetic brake 17, the generator 25, the disc brake 30, the powder brake 40 and the oil damper 50. Namely, if the brake force of these brakes is smaller than an optimum range, the gimbal 14 is over swung or rotated to output the oscillation suppression torque (output). Also, if the brake force is larger than the optimum range, the gimbal could not be swung, and in the same manner, the oscillation suppression torque (output) could not be obtained and the oscillation suppression of the object to be controlled could not be attained.

Figure 12A:
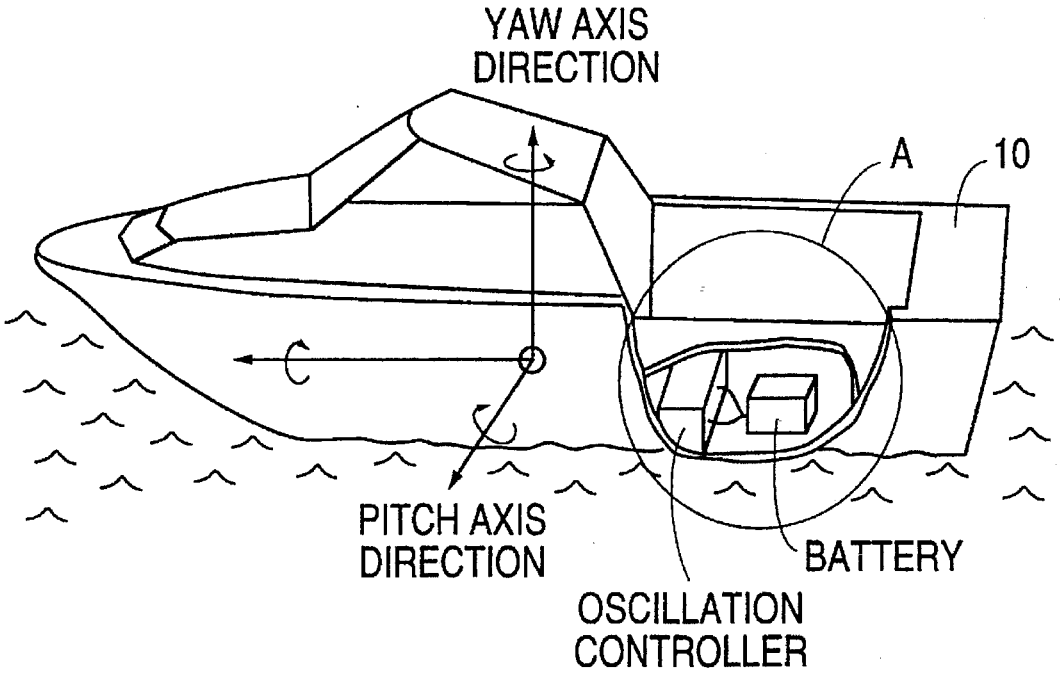
FIG. 12A is a schematic fragmentary view showing a ship with the oscillation suppression device in accordance with the first embodiment of the invention.
Figure 12B:
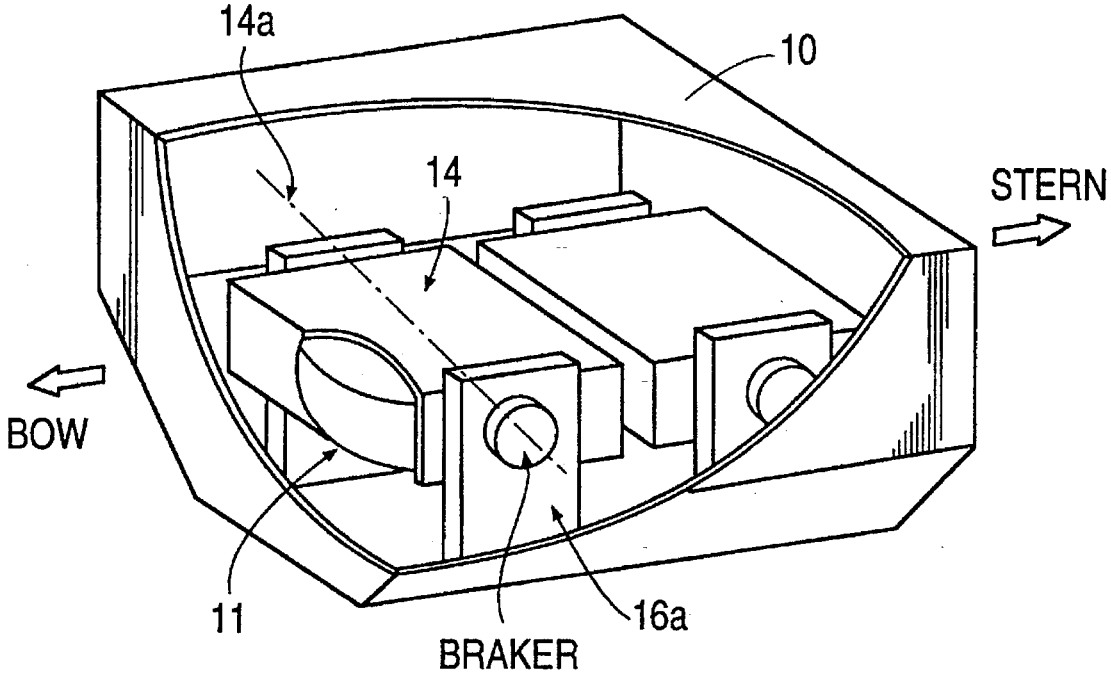
FIG. 12B is an enlarged view showing a part A of FIG. 12B.

FIG. 12A shows an embodiment in which the oscillation suppression device is applied to a boat and FIG. 12B is an enlarged view showing a part A of FIG. 12A.

Figure 13A:
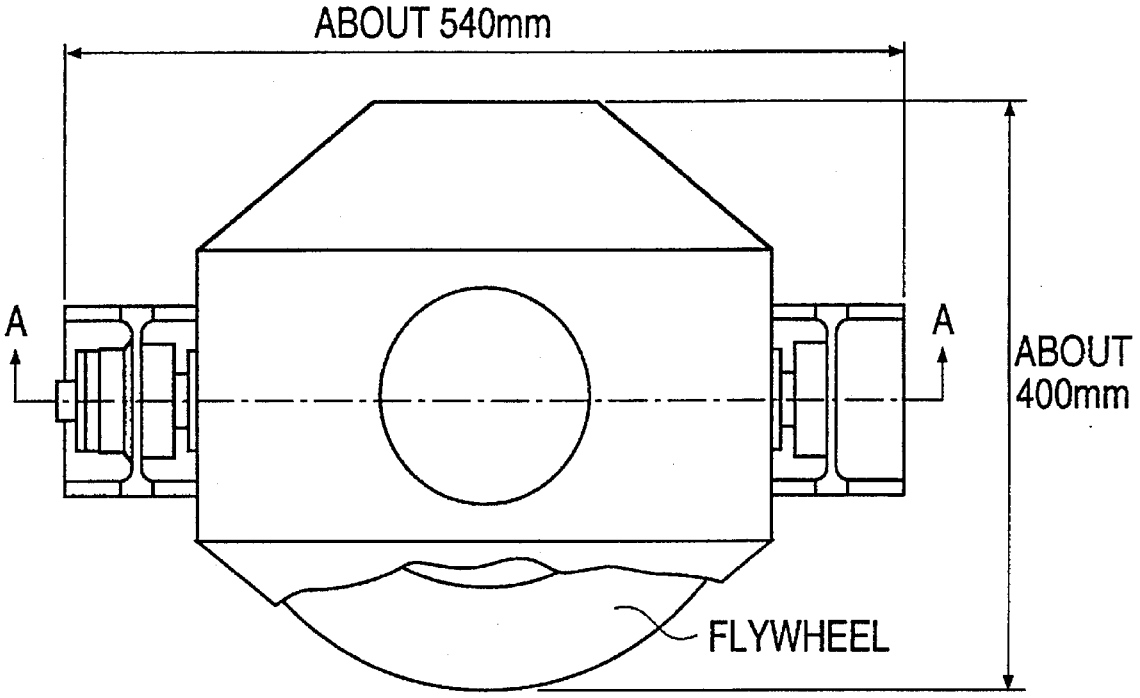
FIG. 13A is a view showing an example of an overall oscillation suppression device according to the invention.
Figure 13B:
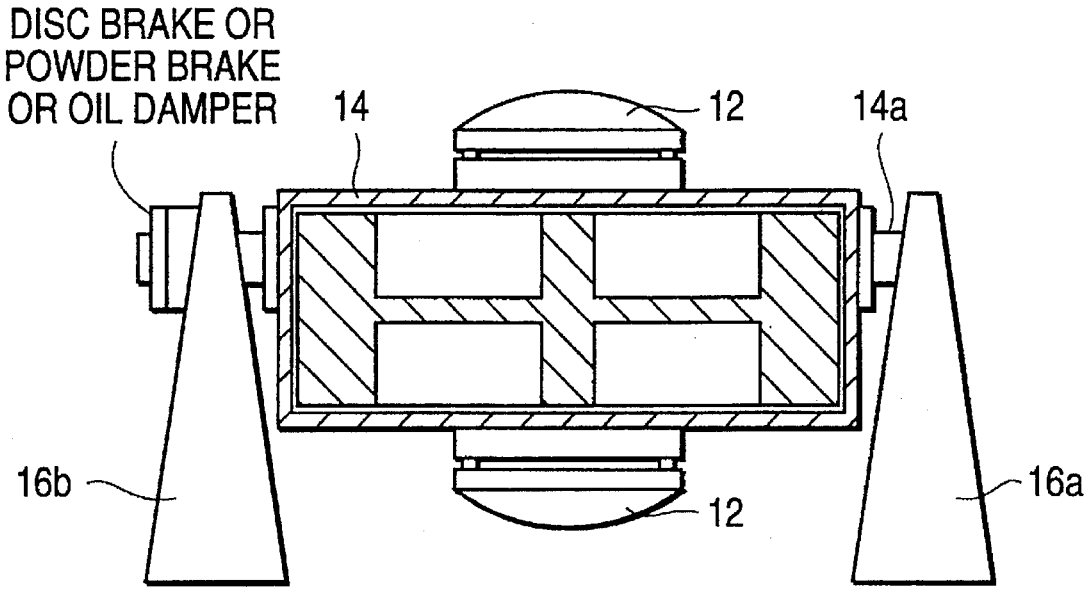
FIG. 13B is a cross-sectional view taken along the line A—A of FIG. 13A.
Figure 14:
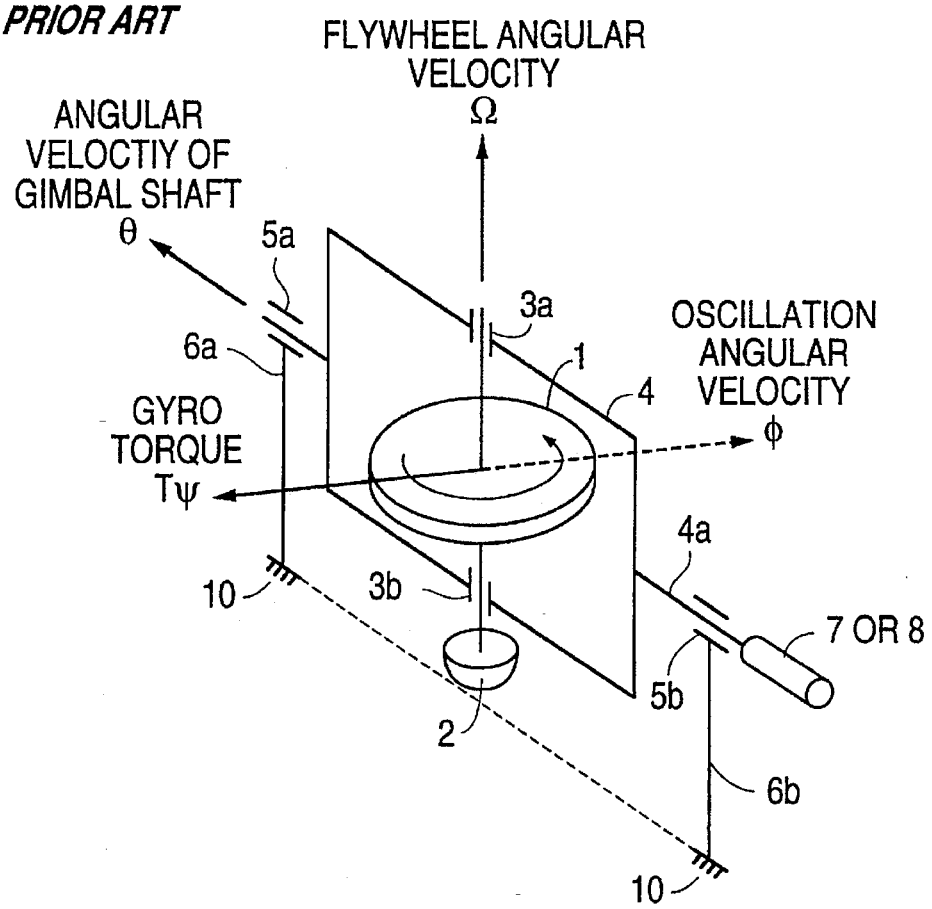
FIG. 14 PRIOR ART
FIG. 14 is a schematic view showing an example of a conventional oscillation suppression device.
Figure 15:
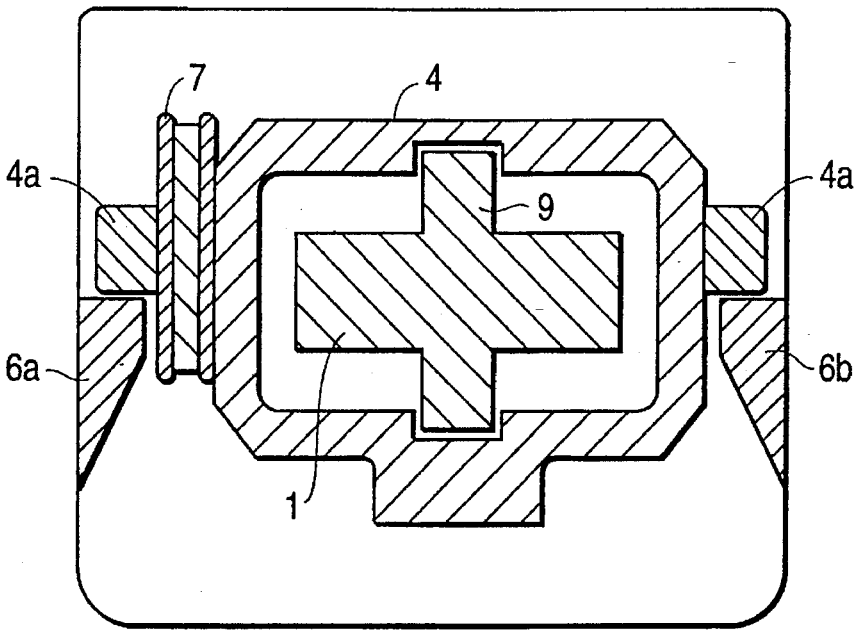
FIG. 15 PRIOR ART
FIG. 15 is a cross-sectional view showing another example of the conventional oscillation suppression device.

Upon mounting the oscillation suppression device onto the boat 60, the gimbal 14*a* should be arranged perpendicular to the longitudinal axis of the boat 60 as shown in FIG. 12B. In this embodiment, the two oscillation suppression devices are mounted but it is possible to mount only one oscillation suppression device. FIGS. 13A and 13B show the arrangement of the respective devices according to this embodiment.

In the case where these devices are driven, the gimbal shafts 14*a* and the gimbals 14 are swung, and the oscillation suppression torque is generated in the roll axial direction. Since the gimbal shafts are slanted, a component force is generated in the yawing axial direction (vertical direction). However, by mounting the two oscillation suppression devices for one set (two devices/one set) on the boat 60, the rotations of the flywheels 11 are opposite to each other to thereby cancel the component force of the yawing axial direction. Also, it is unnecessary to mechanically or electrically connect the two devices, and hence this arrangement can advantageously be utilized in a limited space such as in the boat 60 or the like.

Various details may be changed without departing from the spirit or the scope of the present invention. Furthermore, the foregoing description of the embodiments according to the present invention is provided for the purpose of illustration only, and not for the purpose of limiting the invention as defined by the appended claims and their equivalents.

What is claimed is:

1. An oscillation suppression device comprising:

a support frame having rotary bearings;

a gimbal having a gimbal shaft and being rotatably supported by said bearings on said support frame;

a flywheel rotatably supported in said gimbal;

a motor operably coupled to said flywheel;

means for supplying a constant voltage to said motor including a current limiter and a battery;

an angular velocity detector adapted to detect an angular velocity of an object in which oscillation is to be suppressed and emitting a signal corresponding to the detected angular velocity of the object; and control means provided on said gimbal shaft for controlling the angular velocity of said gimbal in response to the signal from said angular velocity detector.

2. The oscillation suppression device as claimed in claim 1, wherein said control means comprises:

a disc brake including a first friction disc fixed to said gimbal shaft and a second friction disc fixed to said support frame.

3. The oscillation suppression device as claimed in claim 1, wherein said control means comprises:

an electromagnetic brake connected to said gimbal shaft; and an electromagnetic brake control means for controlling said electromagnetic brake in response to the angular velocity detected by said angular velocity detector.

4. The oscillation suppression device as claimed in claim 1, wherein said control means comprises:

a generator connected to said gimbal shaft;

a variable resistor connected to said generator; and a resistor value control means for controlling a resistor value of said variable resistor in response to the angular velocity detected by said angular velocity detector.

5. The oscillation suppression device as claimed in claim 1, wherein said control means is a powder brake comprising:

a casing fixed to said support frame;

a magnetic disc coupled to said gimbal shaft and surrounded by said casing;

a plurality of magnets mounted in said casing; and a magnetic viscous material sealed in said casing.

6. The oscillation suppression device as claimed in claim 1, wherein said control means comprises:

a casing fixed to said support frame and containing oil; and a stirring disc coupled to said gimbal shaft and positioned in said casing such a gap is formed between said disc and said casing.

7. A ship having an oscillation suppression device, said oscillation suppression device comprising:

a support frame having rotary bearings;

a gimbal having a gimbal shaft and being rotatably supported by said bearing on said support frame;

a flywheel rotatably supported in said gimbal;

a motor operably coupled to said flywheel;

a means for supplying a constant voltage to said motor including a current limiter and a battery;

an angular velocity detector adapted to detect an angular velocity of said ship in which oscillation is to be suppressed and emitting a signal corresponding to the detected angular velocity of said ship; and control means provided on said gimbal shaft for controlling the angular velocity of said gimbal in response the signal from said angular velocity detector.

8. The ship having an oscillation suppression device as claimed in claim 7, wherein said gimbal shaft is arranged in parallel to a pitch axial direction of said ship for reducing rolling of said ship.

9. The ship having an oscillation suppression device as claimed in claim 7, wherein said control means comprises a disc brake, provided on said gimbal shaft for controlling the angular velocity of said gimbal in response a signal from said angular velocity detector, including a first friction disc fixed to said gimbal shaft and a second friction disc fixed to said support frame.

10. The ship having an oscillation suppression device as claimed in claim 9, wherein said gimbal shaft is arranged in parallel to a pitch axial direction of said ship for reducing rolling of said ship.

* * * * *